US005495083A

United States Patent [19]

Aymami-Pala et al.

[11] Patent Number: 5,495,083

[45] Date of Patent: Feb. 27, 1996

[54] ELECTRIC SWITCH DEVICE WITH SEPARABLE CONTACTS INCLUDING FIXED CONTACT MOUNTED CURRENT LIMITER AND SHUNT CONDUCTOR

[75] Inventors: Juan Aymami-Pala, Nanterre; Joël Devautour, Saint Germain en Laye; Jean-Pierre Guery, Le Pecq; Michel Rapeaux, Clamart, all of France

[73] Assignee: Schneider Electric SA, Boulogne-Billancourt, France

[21] Appl. No.: 362,911

[22] Filed: Dec. 23, 1994

[30] Foreign Application Priority Data

Dec. 24, 1993 [FR] France ..... 93 15717

[51] Int. Cl.[6] ..... H01H 9/42; H01H 33/16

[52] U.S. Cl. ..... 218/1; 218/31; 218/36; 218/143; 218/146; 218/147; 218/148; 335/201

[58] Field of Search ..... 218/8–21, 30–39, 218/40, 22–29, 146–149, 155–158, 143; 335/6, 201, 16

[56] References Cited

U.S. PATENT DOCUMENTS

| | | | |
|---|---|---|---|
| 2,650,971 | 9/1953 | Dawe | 218/31 |
| 3,515,829 | 6/1970 | Hurtle et al. | 218/31 |
| 3,564,176 | 2/1971 | Fechant | 218/34 X |
| 3,927,350 | 12/1975 | McConnell | 218/144 X |
| 4,421,959 | 12/1983 | Chen et al. | 200/16 A |
| 4,642,429 | 2/1987 | Mori et al. | 218/151 |
| 4,689,588 | 8/1987 | Murata et al. | 218/147 X |
| 5,097,104 | 3/1992 | Weichert | 218/146 |
| 5,142,111 | 8/1992 | Blanchard et al. | 218/22 |
| 5,146,055 | 9/1992 | Boucheron et al. | 218/156 |
| 5,150,033 | 9/1992 | Conway | 320/51 |
| 5,373,273 | 12/1994 | Guery et al. | 335/201 |

FOREIGN PATENT DOCUMENTS

| | | | |
|---|---|---|---|
| 124620 | 11/1984 | European Pat. Off. | H01H 9/30 |
| 207458 | 1/1987 | European Pat. Off. | H01H 9/46 |
| 2581790 | 11/1986 | France | H01H 71/46 |
| 1177713 | 9/1964 | Germany | H01H 9/42 |
| 1182323 | 11/1964 | Germany | H01H 9/42 |

*Primary Examiner*—J. R. Scott

*Attorney, Agent, or Firm*—Oblon, Spivak, McClelland, Maier & Neustadt

[57] ABSTRACT

An electrical switch device with separable contacts is provided with a shunt conductor adapted to receive one end of the arc that is struck when the contacts separate after it has jumped a dielectric gap. The shunt conductor determines an interim arc current path in which is a current limiter device.

7 Claims, 2 Drawing Sheets

ELECTRIC SWITCH DEVICE WITH SEPARABLE CONTACTS INCLUDING FIXED CONTACT MOUNTED CURRENT LIMITER AND SHUNT CONDUCTOR

BACKGROUND OF THE INVENTION

Field of the Invention

The present invention concerns an electric switch device comprising separable contacts respectively disposed on a fixed contact conductive part and a mobile contact conductive part which are connected to input and output terminals of the device, an arc extinguishing chamber and a shunt conductor adapted to receive, after it has jumped a dielectric gap, one end of the arc generated on separation of the contacts and displaced towards the arc extinguishing chamber by the usual blast arrangements or phenomena.

Description of the Prior Art

Devices of this kind are described in patent FR-A-2 584 529, in which the shunt conductor shunts and consequently protects electromechanical and electronic switching units in series with the contacts concurrently with the arcing phenomenon.

Document EP-A-0 350 825 describes the combination of the shunt conductor, which in this instance includes the arc extinguishing device, with a current limiter device opening electrodynamically in the event of an overcurrent. Operation of the electrodynamically opening device is conditioned by the growth of the arc in the arc splitter plates which constitute the arc extinguishing device and therefore by the configuration and the performance of this device.

An object of the invention is, in an electromechanical switch device of the type described, to combine a reduction in the loading of the contacts by the arc and a limitation of the transient shunt current, independently of the arc extinguishing device.

SUMMARY OF THE INVENTION

The invention consists in an electromechanical switch device comprising:

at least one fixed contact and one mobile contact that can be separated, respectively disposed on a fixed contact conductive part and on a mobile contact conductive part, an arc extinguishing chamber and a shunt conductor adapted to receive, after it has jumped a dielectric gap, one end of the arc generated on separation of the contacts and displaced towards the arc extinguishing chamber by blast means, wherein:

the shunt conductor has a surface for receiving the end of the arc and a connection area connected to the fixed contact part to determine between this surface and this area an interim arc current path, a current limiter device is disposed on the transient path between the receiving surface and the connection area.

The current limiter device is, for example, a resistive device, preferably a positive temperature coefficient resistor, in the form of a plate parallel to and placed on the fixed contact part and fixed or gripped between a connecting branch of the shunt conductor and the fixed contact part. This simplifies assembly and the resistive plate is then in direct thermal conduction contact with the fixed contact part; when carrying the nominal current, with the contacts closed, the fixed contact part is at a temperature higher than ambient temperature, and so this provision makes the transient contact opening operation less sensitive to ambient temperature.

In one very simple embodiment of the invention the shunt conductor is a part having the aforementioned connecting branch and a branch or flange parallel to the direction in which the mobile contact moves, this flange providing the surface which receives the end of the arc and which is separated by a small dielectric gap, in the order of 1 mm to 3 mm, for example, from a parallel side of a mobile contact part to facilitate substitution for the arc initially struck between the contacts of an interim arc substantially perpendicular to the latter.

To prevent reactivation or restriking of the arc it can be beneficial to add to the device an insulative screen that can be inserted between the contacts as soon as they open or for the resistor to comprise two positive temperature coefficient resistors connected in parallel.

One non-limiting embodiment of the invention is described by way of example hereinafter with reference to the drawings.

DETAILED DESCRIPTION OF THE PREFERRED EMBODIMENTS

Figure 1:
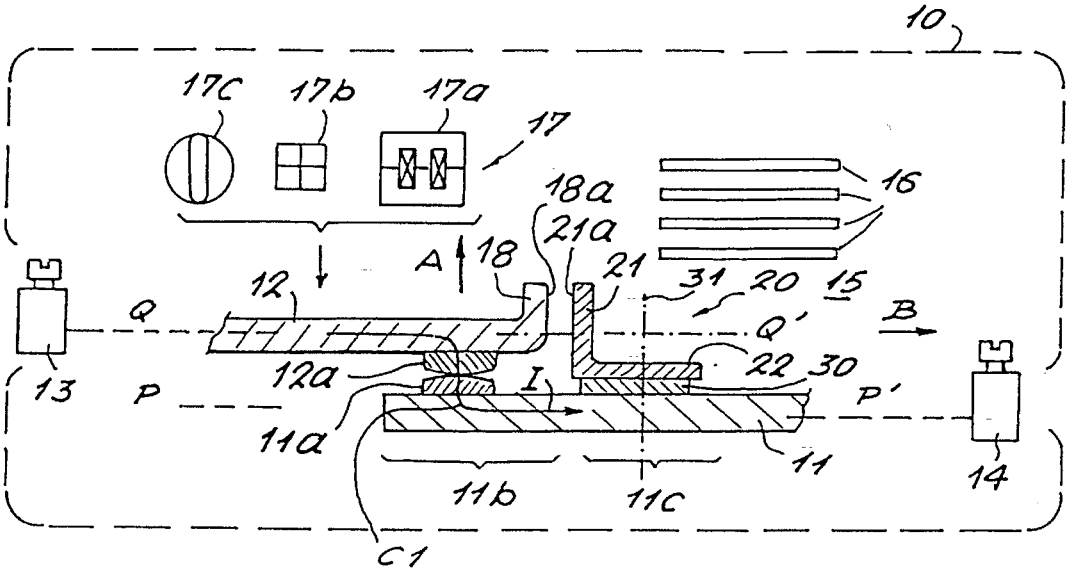
FIG. 1 is a diagram showing an arc extinguishing area of a switch device of the invention with the contacts shown closed.

The electromechanical switch device shown in FIG. 1 is a contactor or a circuit-breaker including in a casing 10 a current feed conductive part or fixed contact 11 and a current feed conductive part or mobile contact 12 respectively carrying a fixed contact 11*a* and a mobile contact 12*a*. The contacts 11*a*, 12*a* can be separated by raising the part 12 in a direction A perpendicular to the planes P—P', Q—Q' of the portions of the parts 11, 12 near the contact area. The mobile and fixed parts 12, 11 are respectively current inlet and outlet conductors—or vice versa—and are connected to input and output terminals 13, 14 of the device.

An arc extinguishing chamber 15, optionally provided with arc splitter plates 16, is provided in the casing 10 at a distance from the contact area in the direction A and in the perpendicular direction B (parallel to P—P' and Q—Q'). The mobile contact part 12 is coupled to an opening and closing device 17 comprising the moving armature of a solenoid 17*a* and/or a tripping mechanism 17*b* and/or a manual operating member 17*c*. Beyond the contact 12*a* the mobile part 12 has an arc horn 18 in the form of an upstand having a plane or substantially plane outside surface 18*a* parallel to the direction A.

An interim arc device 20 is associated with the fixed contact part 11 near the contact area, between the latter and the arc extinguishing chamber 15. The device 20 can instead be associated with the mobile contact part 12, although this is less advantageous. In the present embodiment of the invention the interim arc device 20 is L-shape with, facing the outside surface 18*a* of the mobile arc horn 18, a switching branch 21 with an arc receiving side 21*a* parallel to the surface 18*a* and, facing a plane portion 11*c* of the part 11 parallel to P—P', a connection branch 22 connected to the fixed contact part 11 by means of a connection area 22*a*. The end 11*b* of the part 11 which carries the fixed contact 11*a* is beyond the connection part 11*c*. The connection branch 22 is on the opposite side of the contact to the branch 21, parallel to the plane P—P'. The branches 21 and 22 are therefore perpendicular.

A current limiter device 30 is disposed between the branch 22 and the plane connecting portion 11*c* of the part 11. In the embodiment of the invention shown the limiter device 30 is preferably a flat positive temperature coefficient (PTC) resistor. The limiter device could instead be on the branch 21 or comprise any static limiter device whose curve of impedance as a function of current has a knee or a strong inflection. The advantage of the arrangement shown is that the flat resistor, having a surface 30*a* in contact with the plane surface 11*c* of the fixed contact part 11 and a surface 30*b* in contact with the branch 22 of the shunt part 20, is therefore in close thermal conduction contact with the fixed part 11 in which the nominal current I flows between the terminals 13, 14 when the device is closed, which minimizes the effect of ambient temperature on the operation of the limiter device. Fixing and gripping means 31 separately, even removably, fix the interim arc device 20 to the fixed contact part 11 and grip the flat resistor 30 between 20 and 11. Note that in FIGS. 1 and 2 the connection surface 30*a* forms the connection area 22*a*.

Figure 2:
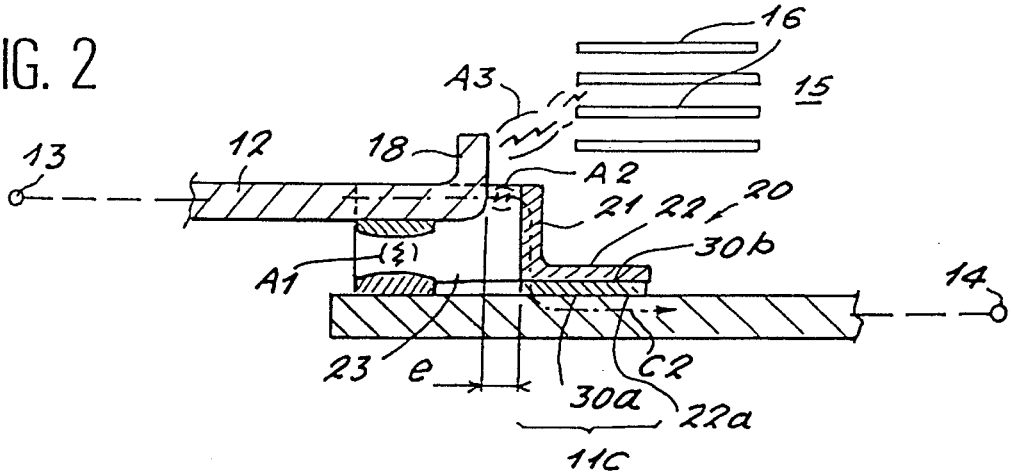
FIG. 2 shows the contacts of the device during opening.

The operation of the device will be explained with reference to FIG. 2. Assuming that the contacts are initially closed, a nominal current I flows between the terminals 13 and 14 along a path C1 which includes the mobile part 12, the contacts 12*a* and 11*a*, and the end portion 11*b* and the connection portion 11*c* of the fixed part 11. When the device 17 is operated the conductive part 12 is raised and the contacts 11*a*, 12*a* separate. An arc A1 is struck between the contacts, initially oriented in the direction A. As soon as the distance between the contacts exceeds the distance e between the facing fixed and mobile surfaces 21*a* and 18*a*, which is preferably between 1 mm and 3 mm, the arc A1 switches to an interim arc A2 between these two surfaces and therefore oriented in the direction B perpendicular to the direction A. The plasma generated in the narrow gap of width e favours the striking and maintaining of the arc A2 which reduces the loading on and wear of the contacts. The current continues to flow between terminals 13 and 14 through a path C2 which includes the mobile part 12, the horn 18, the arc A2, the branches 21 and 22 of the interim arc device 20, the flat resistor 30, the connecting portion 11*c* of the fixed contact part 11. This current is limited as soon as it exceeds the knee in the characteristic of the positive temperature coefficient resistor, which provides the necessary protection.

As the conductive part 12 continues to rise, the interim arc A2 switches to an arc A3 between the horn 18 and the arc extinguishing plate 16, where the arc remains until its complete extinction, the current path C2 being interrupted as soon as the arc A2 disappears.

Figure 3:
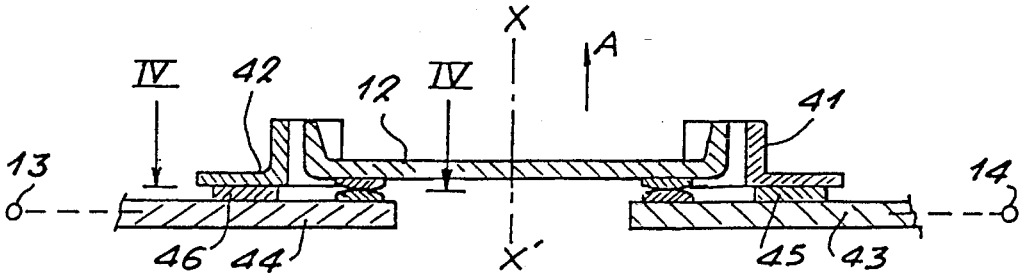
FIG. 3 is a diagram showing the contact area of a double-contact switch device.

Referring to FIG. 3, the switch device can be of the double-contact type with two interim arc devices 41, 42 disposed symmetrically to the axis X—X' of the bridge 12 and laid on the respective fixed contact parts 43, 44 via flat PTC resistors 45, 46. These resistors preferably have identical characteristics.

Figure 4:
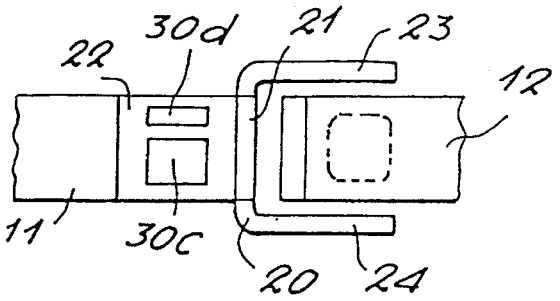
FIG. 4 is a plan view on the section line IV—IV in FIG. 3 of a contact area with two positive temperature coefficient resistors connected in parallel.

The interim arc device 20 can have two branches 23, 24 parallel to the direction B (see FIGS. 2 and 4) surrounding the contact area to contribute to magnetic extinction of the arc. The PTC resistor 30 can include a plurality of resistors, for example two resistors 30*c*, 30*d* (see FIG. 4) connected in parallel so that the two resistors are switched successively, advantageously with different values so that the less resistive resistor 30*c* switches before the more resistive resistor 30*d*.

Figure 5:
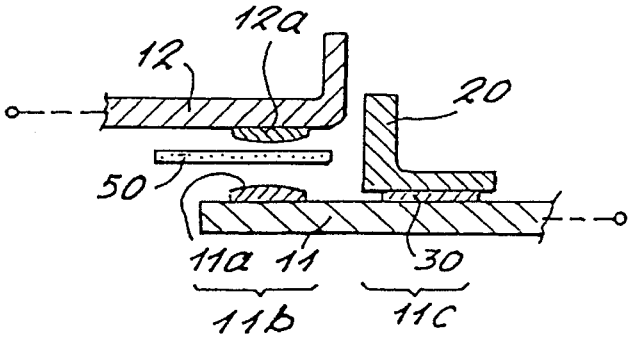
FIG. 5 is a diagram showing the addition of a dielectric screen between the contacts.

The same result can be achieved by an insulative screen 50 (FIG. 5) inserted between the contacts 11*a*, 12*a* when the latter separate.

Figure 6:
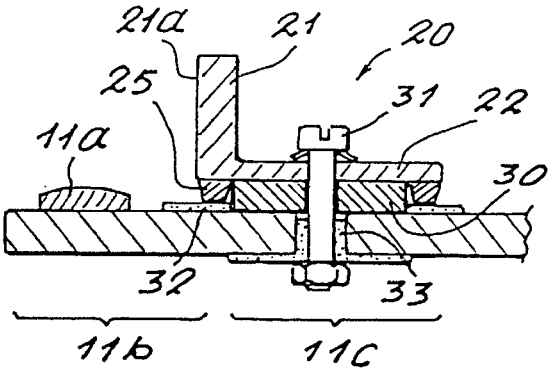
FIG. 6 shows one way of assembling the shunt part to the fixed contact part.

FIG. 6 shows one way of mounting the removable interim arc device 20 on the connecting portion 11*c* of the fixed contact part 11. The fixing and gripping device 31 is, for example, a screw inserted in a hole in the part 20 and the plate 30 and in a hole in the part 11, with an insulative layer 32 between bearing elements 25 of the part 20 and the portion 11*c* and an insulative bush 33 inserted in the hole in the part 11.

The current limiter device 30 could instead be gripped between two component parts of the shunt part 20.

Figure 7:
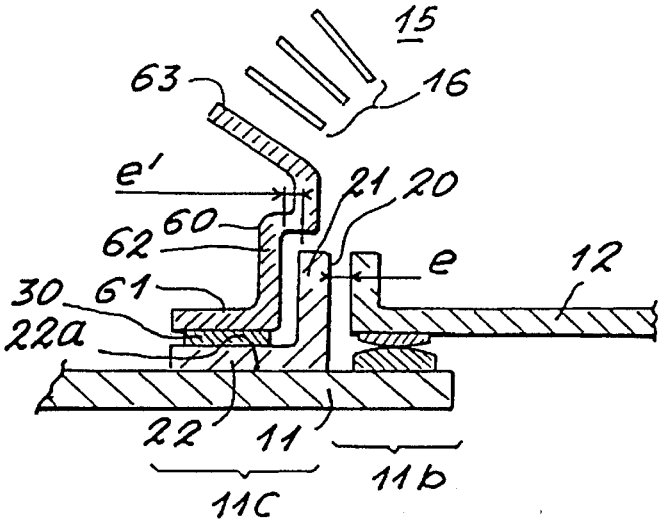
FIG. 7 shows an alternative embodiment of the contact area.

FIG. 7 shows a different embodiment in which the interim arc device 20 is fixed to the connecting portion 11*c* of the fixed contact part 11, the resistive plate 30 being disposed on the surface 22*a* of the branch 22 opposite the part 11. One branch 61 of a deflector part is fixed to the upper surface of the plate 30. The part 60 has a branch 62 parallel to the branch 21 of the part 20 to define a small gap of thickness e' between these branches and a deflector end 63 facing towards the arc extinguishing chamber 15.

Figure 8:
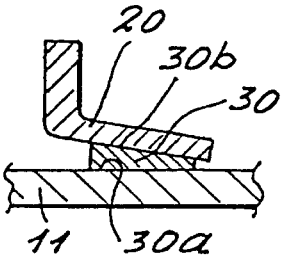
FIG. 8 is a view in section of an alternative resistive plate.

FIG. 8 shows a flat PTC resistor 30 with one contact surface, the surface 30*b*, for example, oblique to achieve a predetermined variation of resistance.

What is claimed:

1. Electromechanical switch device comprising:

a fixed contact conductive part;

at least one fixed contact disposed on said fixed contact conductive part;

a mobile contact part;

a mobile contact mounted on said mobile conductive part, said mobile contact being movable in a direction of displacement to separate from said fixed contact;

a shunt conductor for receiving an arc from said mobile contact part when said mobile contact separates from said fixed contact, said shunt conductor having a connection area connected to said fixed contact conductive part and a surface for receiving said arc;

a current limiter device disposed between said connection area of said shunt conductor and said fixed contact conductive part;

an interim arc path being formed by said mobile contact, said shunt conductor, said current limiter device and said fixed contact conductive part; and an arc extinguishing chamber for receiving an arc from said mobile contact part after said mobile contact part moves past said shunt conductor.

2. Electromechanical switch device according to claim 1 wherein said arc receiving surface is parallel to the direction of displacement of said mobile contact part.

3. Electromechanical switch device according to claim 1 wherein said current limiter device is placed on said fixed contact part and is fixed or gripped between said connection area of said shunt conductor and said fixed contact part, said connection area being parallel to the plane of said fixed contact part.

4. Electromechanical switch device according to claim 1 wherein said mobile contact part is a contact bridge, said shunt conductor is an L-shaped part having one branch parallel to the direction of displacement of said bridge, this branch having the surface for receiving said arc, separated by a small dielectric gap from a parallel surface of said mobile bridge, and a connection branch connected to said fixed contact part.

5. Electromechanical switch device according to claim 1 wherein said current limiter device is a positive temperature coefficient resistor.

6. Electromechanical switch device according to claim 4 wherein there is provided on each side of said contact bridge a shunt conductor with associated positive temperature coefficient resistor, the two resistors having substantially the same characteristics.

7. Electromechanical switch device according to claim 5 wherein said positive temperature coefficient resistor comprises two resistors connected in parallel.

* * * * *